US006247593B1

(12) United States Patent
Ruble

(10) Patent No.: US 6,247,593 B1
(45) Date of Patent: Jun. 19, 2001

(54) CARTON HAVING INTEGRALLY FORMED ALIGNMENT RETAINER TABS

(75) Inventor: Steve B. Ruble, Lexington, KY (US)

(73) Assignee: Ashland Inc., Lexington, KY (US)

( * ) Notice: Subject to any disclaimer, the term of this patent is extended or adjusted under 35 U.S.C. 154(b) by 0 days.

(21) Appl. No.: 09/714,639

(22) Filed: Nov. 16, 2000

Related U.S. Application Data

(63) Continuation-in-part of application No. 29/102,144, filed on Mar. 17, 1999, now abandoned.
(60) Provisional application No. 60/196,023, filed on Apr. 7, 2000.

(51) Int. Cl.[7] ..... B65D 21/032
(52) U.S. Cl. ..... 206/509; 229/915
(58) Field of Search ..... 206/509, 511, 206/512; 229/915

(56) References Cited

U.S. PATENT DOCUMENTS 1,856,729 * 5/1932 Robinson ..... 229/915
3,163,344 * 12/1964 Tunick ..... 206/509
3,287,075 * 11/1966 Batke et al. ..... 206/509
4,134,533 * 1/1979 Heavner ..... 229/915
4,658,961 * 4/1987 Tamura ..... 206/509
5,115,965 * 5/1992 Alepuz ..... 206/509
5,662,508 * 9/1997 Smith ..... 229/915

* cited by examiner

*Primary Examiner*—Gary E. Elkins
(74) *Attorney, Agent, or Firm*—Carrithers Law Offices; David W. Carrithers

(57) ABSTRACT

The present invention is for a carton or box for holding containers such as oil bottles wherein the box is formed from a single sheet of precut corrugated material so that the upper edges have short tabs which cooperatively engage slots formed in the bottom of said boxes. The tabs are long enough to provide resistance to stacked boxes from sliding over one another but sized and shaped so as to not interfere with intentional stacking and moving of the boxes using manual labor or equipment. The tabs engage the slots in order to biase the boxes but not prevent all lateral movement.

4 Claims, 3 Drawing Sheets

CARTON HAVING INTEGRALLY FORMED ALIGNMENT RETAINER TABS

This application is a Continuation-In-Part of U.S. patent application Ser. No. 29/102,144 filed on Mar. 17, 1999 now abandoned and claims priority from Provisional Application Ser. No. 60/196,023 filed on Apr. 7, 2000.

BACKGROUND OF THE INVENTION

Technical Field

This invention relates generally to stackable containers made from blanks of paper board, cardboard, corrugated cardboard, fibreboard and/or plastics material and more particularly to a container (and blank to form the same) having tabs, on a pair of opposite sidewalls, projecting a selected distance upwardly from the top end of the container and tab receiving notches in the outer layer of a double layer bottom end face. The tabs on one container project into the notches of another like container stacked thereon.

Description of the Prior Art

Stackable containers are known that have tabs projecting upwardly from the top of one container into openings in the bottom and side walls of a like container stacked thereon. The cooperating aligned tabs and holes assist in preventing the upper containers from sliding of f the container it is resting on and also provides means to ensure alignment of the stacked containers and thus an even weight distribution. The normally smooth container surfaces provides low frictional engagement and thus sliding is a problem particularly during transport.

While it is acceptable to have holes in the containers and even in some instances it is desirable, for example containers for fresh fruit and/or vegetables, there are many instances when holes through the container walls are detrimental. Holes can be the cause of losing small articles and they can provide an entry way into the container for mice.

There is an abundance of related prior art disclosing containers having panels interconnected by fold lines and with tabs projecting from the top that fit into holes in the bottom and side walls of a like container resting thereon. Conventional cartons are known to have tabs; however, these tabs are interlocking to prevent any movement of one carton from moving from the adjacent carton.

The following are believed to be the most pertinent references with respect to the present invention: U.S. Pat. Nos. 5,662,508 issued to M. A. Smith; 4,709,852 issued to M. S. Stoll; 4,373,659 issued to W. F. Cornell et al; and 3,287,075 issued to L. A Batke et al.

The above '508 Patent discloses a pair of tabs projecting upwardly from each of a pair of opposite side walls of the container and aligned therewith are holes in each of the corresponding side walls and which extend into the bottom panel of the container. The tabs projecting upwardly from one container fit into the holes of a like container resting thereon. The blank for the container has a series of panels separated one from the next by fold lines and extending from opposite edges of the center one of this series of panels is a further series of panels separated one from the next by further fold lines. Holes in the walls are often undesirable and the blank is not a simple rectangular blank resulting in considerable wastage of material when cutting out the blank from a piece of stock.

The '853 patent is perhaps the most pertinent with respect to the present invention in that it discloses notches in a pair of bottom flaps but as is the case with the above patent there are holes in the sidewalls that also extend into the bottom panel for receiving a tab therein. In this instance, the holes are desirable as the container in intended for transporting produce. The panels have equal width flaps extending from the top edge of the panels defining the side walls of the container and the flaps extending from the opposite edge differ in width. Two of the bottom wall flaps have, as previously mentioned, notches for the upwardly projecting tabs. The length of the tabs i.e. the amount they project upwardly from the wall associated therewith is limited only by the depth of the cut out in the side wall that defines the hole to receive the tab. The '659 patent discloses stacking alignment tabs that project into holes in the container removable top and into a hole in the bottom and side wall of a like container resting thereon.

SUMMARY OF INVENTION

The present invention is for a carton or box for holding containers such as oil bottles wherein the box is formed from a single sheet of precut corrugated material so that the upper edges have short tabs which cooperatively engage slots formed in the bottom of said boxes. The tabs are long enough to provide resistance to stacked boxes from sliding over one another but sized and shaped so as to not interfere with intentional stacking and moving of the boxes using manual labor or equipment. The tabs engage the slots in order to biase the boxes but not prevent all lateral movement. There is, therefore, a need for, and it is an object of this invention to provide, an automatic, noncylindrical container orienting apparatus existing in modular form for quick installation and ease of maintenance.

More particularly, the present invention defines a container forming a unitary blank and a container formed therefrom and in which the container has a first pair and a second pair of vertically disposed sidewalls with an end flap on each at each of the top and bottom ends thereof. The end flaps fold inwardly and provide a double layer at each of the top and bottom ends of the container. The end flaps providing the inner layer at top end have a generally rectangular 'U'-shape cutline commencing at the fold line associated therewith and extending a selected distance away therefrom into the flap and thereby provide tabs of sufficient length to project upwardly above the outer layer at the top end of the container. A pair of the flaps at the bottom end providing the outer layer have notches in each of opposite side edges thereof and these notches are aligned with the tabs to inter-fit therewith when like containers are stacked one on top of another. The tabs project above the top of the container an amount no greater than the thickness of the end flaps having the tab receiving notches therein.

The present invention allows for limited movement; however, the tabs cooperatively engage but do not interlock to prevent all movement. The tab and slot arrangement only serves to prevent cartons from sliding across one another and off of the stack during stacking and packing operations.

An object of the present invention is to provide a one piece rectangular blank, foldable along predetermined fold lines into a container, that minimizes wastage.

A principal object of the present invention is to provide a one piece blank that is foldable to form a container having two layer top and bottom end walls and a container with stacking alignment tabs that project from the top wall into only the single outer layer of the bottom wall two layers of a like container resting thereon.

A further principal object of the present invention is to provide a container as described in the forgoing objects and wherein there are no holes that extend through the walls of the container.

In keeping with the forgoing there is provided a rectangular one piece container blank foldable along predetermined fold lines to form a container having a first pair and a second pair of vertically disposed sidewalls, each of said side walls having a top end flap and a bottom end flap, said end flaps being connected to the side wall associated therewith by a fold line, said end flaps of said first pair of side walls being folded inwardly in a direction toward one another providing an inner wall at each of said top and bottom ends of the container and said end flaps of said second pair of side walls being folded inwardly along their respective fold lines in a direction toward one another to overlie the end flaps on said first pair of side walls and thereby provide an outer layer on each of the respective top and bottom ends of the container, said flaps connected to said first pair of side walls and located at the top end of the container having a generally rectangular 'U'-shape cutline commencing at the fold line associated therewith and extending a selected distance away therefrom into the flap to provide a tab that projects upwardly above the outer layer at the top end of the container and a notch in each of opposite side edges of the end flaps on the second pair of side walls at the bottom end of the container that provide the outer layer at the bottom end of the container, said notches being aligned with said tabs whereby the tabs at top end of one container project into the notches of a second like container stacked thereon.

The present invention allows for limited movement; however, the tabs cooperatively engage but do not interlock to prevent all movement. The tab and slot arrangement only serves to prevent cartons from sliding across one another and off of the stack during stacking and packing operations.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENT

Figure 1:
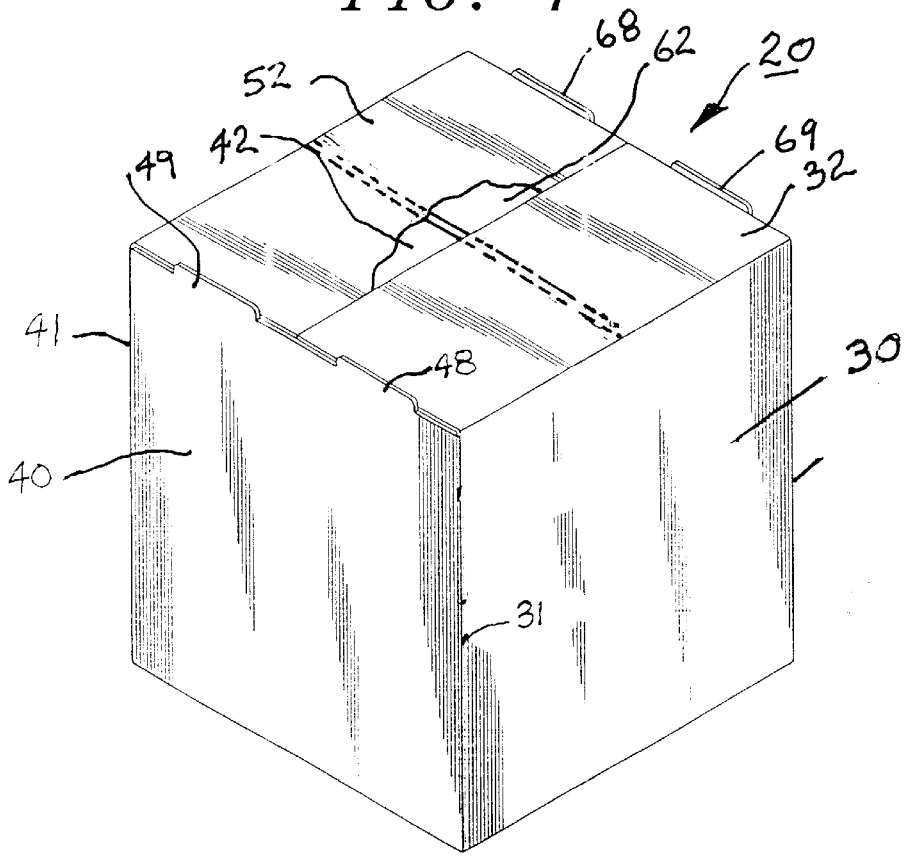
FIG. 1 is an oblique view of a container provided in accordance with the present invention.
Figure 2:
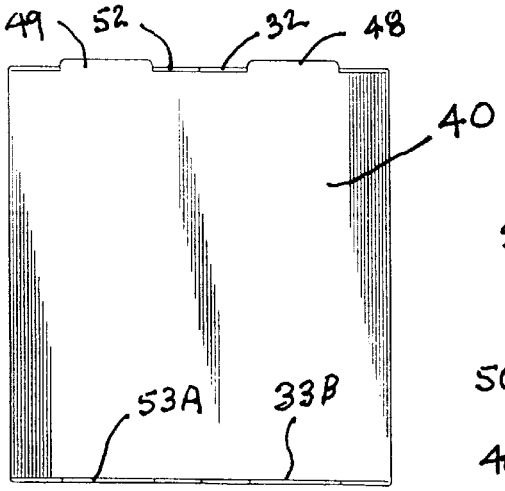
FIG. 2 is a left side elevational view of the container shown in FIG. 1.
Figure 3:
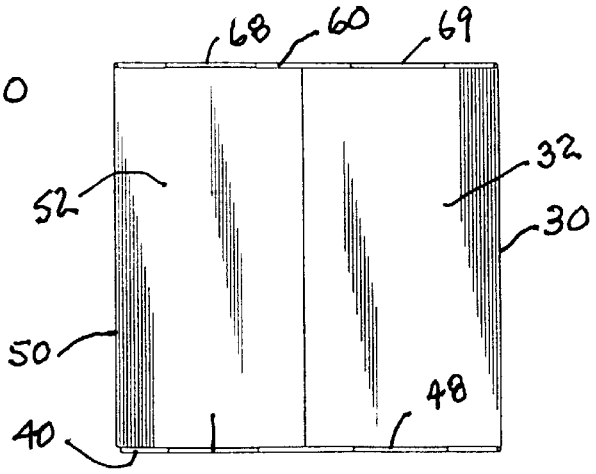
FIG. 3 is a top plan view of the container shown in FIG. 1.
Figure 4:
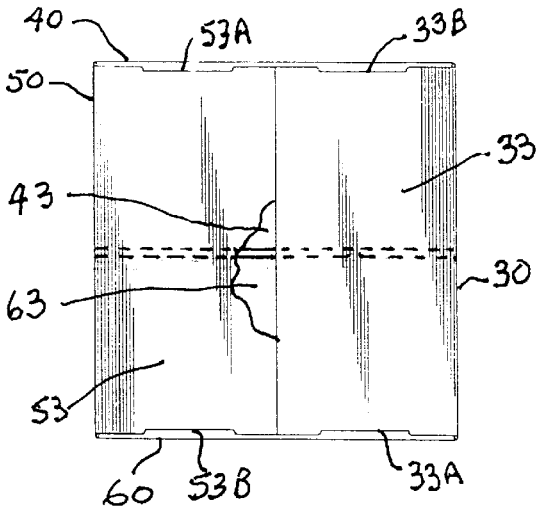
FIG. 4 is a bottom view of the container shown in FIG. 1.
Figure 5:
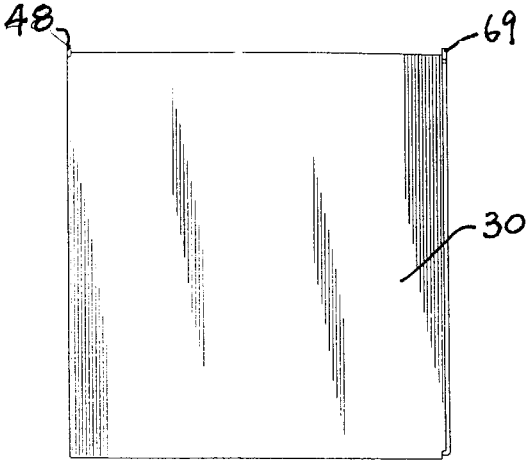
FIG. 5 is a front elevational view of the container shown in FIG. 1.
Figure 6:
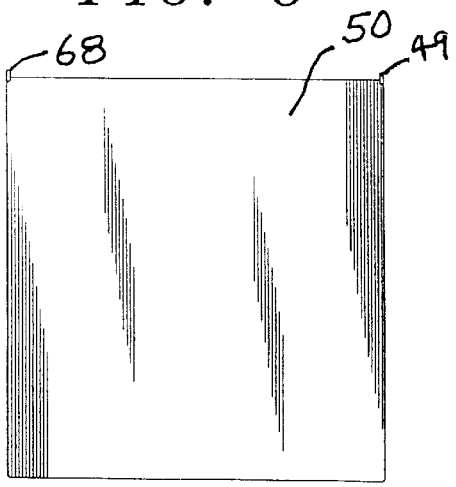
FIG. 6 is a rear elevational view of the container shown in FIG. 1.
Figure 7:
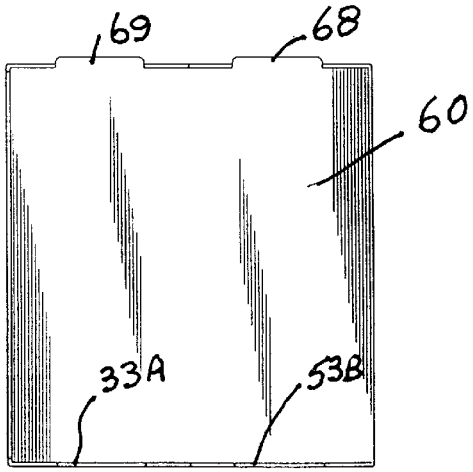
FIG. 7 is a right hand elevational view of the container shown in FIG. 1.
Figure 8:
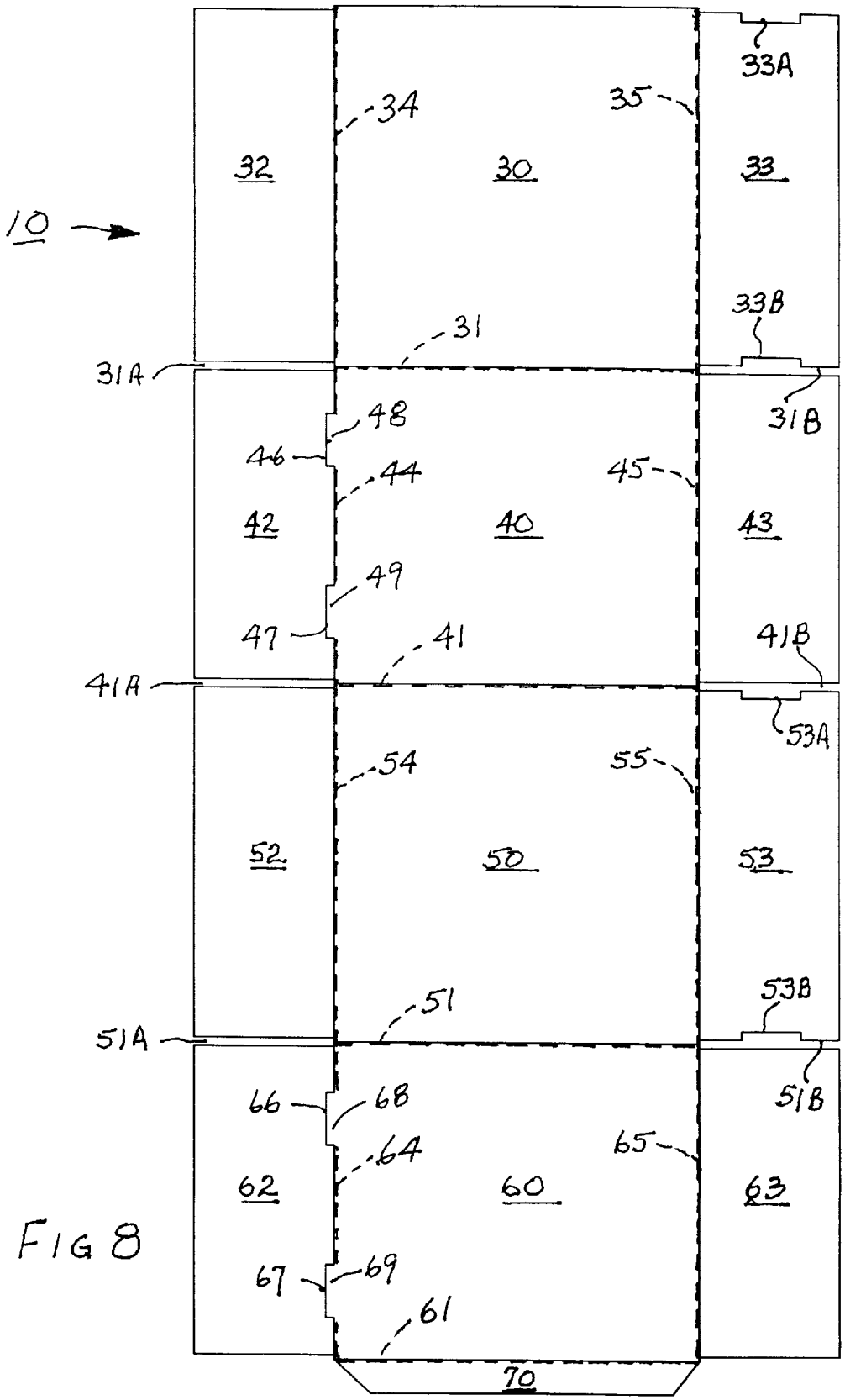
FIG. 8 is a plan view of a single blank cut from stock and showing the fold and cut lines providing panels and flaps that fold along the fold lines to form the container shown in the foregoing figures.

Referring to the drawings in FIGS. 1–8 there is illustrated a one piece i.e. unitary rectangular blank 10 having panels interconnected by fold lines and when folded along these lines provide a stackable container 20 as shown in the figures. The material of fabrication may be selected from paper board, cardboard, corrugated cardboard, fibreboard, plastics material, and/or combinations thereof.

The blank 10 has series of principal panels 30, 40, 50 and 60 in which panels 30 and 40 are interconnected by a fold line 31, panels 40 and 50 are interconnected by a fold line 41, panels 50 and 60 are interconnected by a fold line 51 and a corner connecting edge flap 70 is connected to the panel 60 by a fold line 61. The panels 30 and 50 provide respectively the front and rear side walls of the container shown i.e. one pair of oppositely disposed side walls of the container and the panels 40 and 60 provide another pair of oppositely disposed side walls. The corner connecting edge flap 70 20 connects to the panel 20, adjacent an edge thereof, by staples and/or an adhesive. The flap 70, while shown attached to the panel 60, could if desired be connected to and associated with any one of the other remaining principal panels in which case the series arrangement would be in sequence, obvious to any one skilled in the art, that is different from the sequence shown.

Each principal panel has a pair of end flaps attached thereto by respective ones of a pair of fold lines and these end flaps provide an inner and an outer layer for each of the top and bottom ends of the container. Panel 30 has respective top and bottom wall forming end flaps 32 and 33 connected thereto by respective fold lines 34 and 35 and panel 50 has respective top and bottom wall forming end flaps 52 and 53 connected thereto by respective fold lines 54 and 55. The flaps 32 and 52 are each one half of the width of the top end of the container and together provide the outer layer of the top end of the container. The end flaps 33 and 53 are each one half of the width of the bottom end of the container and together provide the outer layer at such end of the container. Panel 40 has respective top and bottom wall forming end flaps 42 and 43 and panel 60 has respective top and bottom wall forming end flaps 62 and 63. The flaps 43 and 63 are attached to the principal panel associated therewith by respective fold lines 45 and 65 and provide the container bottom wall inner layer.

The fold lines 31, 41, 51, and 61 are parallel to one another and perpendicular to these are fold lines 35, 45, 55, and 65 which are disposed in end-to-end aligned relation. Each of these fold lines is continuous along the length of the panels associated therewith.

The top end inner wall forming flaps 42 and 62 are connected to their respective principal panels 40 and 60 by respective discontinuous fold lines 44 and 64. The fold line 44 is interrupted, and thereby discontinuous, by a spaced apart pair of right angle generally 'U'-shape cut lines 46 and 47 and similarly fold line 64 is interrupted by a spaced apart pair of similar shaped cut lines 66 and 67. The cut lines 46,47 66 and 67 each extend outwardly, from an imaginary continuation of the fold lines 44 and 64 associated therewith, in a direction toward the free outer edge of the end flap and provide respective container stacking alignment tabs 48, 49, 68 and 69. The tabs 48 and 49 are continuations of the side wall panel 40 and the tabs 68 and 69 are continuations of the opposite side wall panel 60 and the amount they project beyond the folded inwardly end flaps 42 and 62 is greater than the thickness of the top outer layer thickness of the top wall (i.e. the layer provided by end flaps 32, 52) and less than the combined thickness of such top wall outer layer and the thickness of the outer layer of the bottom wall (such layer being provided by the end flaps 33 and 53) as will become more evident and apparent hereinafter.

The end flaps 32 and 42 are separated from one another by a cut line 31A as are end flaps 42, 52 by cut line 41A and end flaps 52, 62 by cut line 51A. End flaps 33 and 43 are separated one from the other by cut line 31B, end flaps 43 and 53 by cut line 41B and end flaps 53 and 63 by cut line 51B.

The end flap 33 has rectangular notches 33A and 33B at respective opposite edges thereof and end flap 53 has rectangular notches 53A and 53B in respective opposite edges thereof. When stacking one container on top of another the upwardly projecting tabs 48, 49, and 68, 69 project into respective notches 33B, 53A and 53B, 33A in the bottom of the like container resting thereon. By having the tabs project above the top outer layer (end flaps 32, 52) an amount corresponding to the thickness of the flaps having the notches the tabs abut against the end flaps defining the inner bottom wall of the container.

From the forgoing it is evident the positioning of the tabs and notches are co-related for an iter-fitting inter-nested relation of vertically stacked like containers and the amount the tabs project upwardly is co-related to the thickness of the end flaps 32 and 52 as well as the end flaps 33 and 53 having respective notches 33A, 33B and 53A, 53B. It is also evident the container has a double layer bottom wall and a double layer top wall and there are no holes through the container walls. The holes in the end flaps 42 and 62, as a result of the tabs 48, 49, 68 and 69 being formed therefrom are covered by the end flaps 32 and 52 that provide the outer top wall layer.

The container blank is rectangular with the fold lines 34, 44, 54 and 64 in end to end alignment and parallel to and spaced from the end-to-end aligned fold lines 35, 45, 55 and 65. The end flaps 32, 42, 52 and 62 are of the same width as are also end flaps 33, 43, 53 and 63 and preferably these 8 end flaps are all of the same width.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented herein above. Rather, what is intended to be covered is within the spirit and scope of the appended claims.

I claims:

1. A container comprising a unitary container blank with predetermined fold lines, said container comprising a first pair and a second pair of vertically disposed sidewalls, each of said side walls having a top end flap and a bottom end flap, said end flaps being connected to the side wall associated therewith by a fold line, said end flaps of said first pair of side walls being folded inwardly in a direction toward one another providing an inner wall at the respective top and bottom ends of the container and said end flaps of said second pair of side walls being folded inwardly along their respective fold lines in a direction toward one another to overlie the end flaps on said first pair of side walls and thereby provide an outer layer on each of the respective top and bottom ends of the container, said flaps connected to said first pair of side walls and located at the top end of the container having a generally rectangular 'U'-shape cutline commencing at the fold line associated therewith and extending a selected distance away therefrom into the flap to provide a tab that projects upwardly above the outer layer at the top end of the container and a notch in each of opposite side edges of the end flaps on the second pair of side walls at the bottom end of the container that provide the outer layer at the bottom end of the container, said notches being aligned with said tabs whereby the tabs at top end of one container project into the notches of a second like container stacked thereon.

2. The container as defined in claim 1, wherein said blank is corrugated cardboard.

3. A container as defined in claim 1, wherein said blank includes four principal panels in series and which provide said container sidewalls and wherein one of said principal panels has a corner edge tab joined thereto along an edge thereof by a foldline and means connecting said corner edge tab to the principal panel next adjacent thereto along an edge thereof.

4. A container comprising a unitary blank foldable along predetermined fold lines to form a container, said blank comprising four principal panels in series separated on from the next by a first group of fold lines with such fold lines being disposed in spaced parallel relation, alternate ones of said panels in the series providing a first pair and a second pair of sidewalls for the container, each of said panels having a discrete individual flap at the each of opposite ends thereof and connected thereto by a fold line with the fold lines at one end being aligned in a second series and at the other end aligned in a third series, said second and third series of fold lines being parallel to one another and perpendicular to said first group of fold lines, said flaps providing inner and outer wall layers at each of said top and bottom ends of the container, said flaps at one end on an alternate two of said panels having a generally rectangular 'U'-shape cutline commencing at the fold line associated therewith and extending a selected distance away therefrom into the flap providing tabs which, in an assembled container, project upwardly above the outer layer at the top end of the container and a notch in each of opposite side edges of the end flaps on the other two panels at the opposite end second providing the outer layer at the bottom end of the container, said notches being aligned with said tabs in the assembled container whereby the tabs at top end of one container project into the notches of a second like assembled container stacked thereon.

* * * * *